United States Patent [19]

Morita

[11] 4,021,891

[45] May 10, 1977

[54] MAGNETIC LOCK CLOSURE

[75] Inventor: Tamao Morita, Tokyo, Japan

[73] Assignee: Application Art Laboratories Co., Ltd., Tokyo, Japan

[22] Filed: Apr. 18, 1974

[21] Appl. No.: 462,174

[52] U.S. Cl. ..... 24/201 B; 292/251.5

[51] Int. Cl.[2] ..... A44B 17/00

[58] Field of Search ..... 24/201 B, 73 MS; 292/251.5; 335/302; 339/12 R, 12 G

[56] References Cited

UNITED STATES PATENTS

| | | | |
|---|---|---|---|
| 2,340,781 | 2/1944 | Wagner | 24/201 B |
| 2,397,931 | 4/1946 | Ellis | 24/73 MS |
| 2,615,227 | 10/1952 | Hornik | 24/201 B |
| 2,623,256 | 12/1952 | Feibelman | 24/201 B |
| 2,637,887 | 5/1953 | Goodman | 24/201 B |
| 2,654,929 | 10/1953 | Feibelman | 24/201 B |
| 2,901,278 | 8/1959 | Robinson | 24/201 B |
| 2,954,253 | 9/1960 | Teetor | 292/251.5 |
| 2,954,874 | 10/1960 | Rouse | 24/201 B |
| 2,970,857 | 2/1961 | Squire | 292/251.5 |
| 2,975,497 | 3/1961 | Budreck | 24/201 B |
| 3,009,225 | 11/1961 | Budreck | 24/201 B |
| 3,041,697 | 7/1962 | Budreck | 24/201 B |
| 3,086,268 | 4/1963 | Chaffin | 24/201 B |
| 3,141,216 | 7/1964 | Brett | 24/201 B |
| 3,171,176 | 3/1965 | Shirley | 24/201 B |
| 3,277,681 | 10/1966 | Bey | 24/201 B |
| 3,324,521 | 6/1967 | Humiston | 24/201 B |
| 3,372,443 | 3/1968 | Daddona | 24/201 B |

FOREIGN PATENTS OR APPLICATIONS

| | | | |
|---|---|---|---|
| 155,313 | 7/1956 | Sweden | 292/251.5 |
| 374,845 | 3/1964 | Switzerland | 24/201 B |
| 914,208 | 12/1962 | United Kingdom | 24/201 B |

*Primary Examiner*—Bernard A. Gelak
*Attorney, Agent, or Firm*—Wenderoth, Lind & Ponack

[57] ABSTRACT

A magnetic lock closure used for a handbag or the like for closure comprising two separate parts at least one of which is formed as a female device in a permanent magnet of a cylindrical or any other shape having a hole or slit centrally thereof and its opposite ends magnetized in a different polarity, the female device including a piece of ferromagnetic material firmly provided at one end thereof and having a rod portion for insertion into the hole or slit such that the force of its magnetism is centered about the piece of ferromagnetic material which attracts the other part or male device formed of ferromagnetic material.

8 Claims, 10 Drawing Figures

MAGNETIC LOCK CLOSURE

BACKGROUND OF THE INVENTION

There are known buttons, hooks, strings or snap closures, or zippers for closures or for locking two separate parts. However, these have each advantages and disadvantages. A lock closure using the attraction of a permanent magnet is known and used, but is constructed such that one of its component parts will only attract the other part opposite the first part. The device depends exclusively, or largely, upon the strength of the magnetic attraction for its capability and is relatively highly resistant to any external force that may be exerted at right angles to the end of the magnet. However, it is relatively less resistant to any force that may be applied laterally, so that the parts are apt to slide relative to each other. There is also known a magnetic lock closure which is provided with a hook for preventing such sliding, however, it cannot work as satisfactorily as the present invention.

The magnetic lock closure constructed according to this invention comprises two separate parts, at least one of which is made of a permanent magnet of a cylindrical or any other form having a hole or slit centrally therethrough for providing a female device. The female device also includes a piece of ferromagnetic material firmly secured to one end of the device, so that the force of the magnetic attraction is centered about the piece of ferromagnetic material. This piece may be provided with a rod portion which is inserted into the hole or slit. The magnetic attraction per unit area is thus remarkably increased and is capable of attracting the other part, or male device, which is also made of ferromagnetic material. The male device may be provided with a rod portion for insertion into the hole or slit. The male piece is thus prevented from sliding laterally, thus providing a reliable locking means.

BRIEF SUMMARY OF THE INVENTION

This invention relates to magnetic lock closure comprising two separate parts. At least one of the two parts, the female device, is a permanent magnet of a cylindrical, rectangular or any other form having a hole or slit centrally therein with its opposite ends magnetized in a different polarity. The female device includes a piece of ferromagnetic material rigidly secured to one end thereof and which may preferably be provided with a rod portion for insertion into the hole or slit. The other part, or male device, is made of ferromagnetic material, and is preferably provided with a rod portion inserted into the hole for locking, said rod portion being of enough length to contact the end of the rod portion of the female device opposite it.

With these two parts mated for locking, the force of the magnetism at opposite ends is centered about the two rod portions for attracting each other. The male device with its rod portion inserted into the hole is thus prevented from sliding laterally relative to the end of the female device. It cannot be removed from the female device otherwise than by pulling it at right angles to the end of the magnet.

The lock closure according to the invention can be constructed in a small size, and also provides a reliable locking means. The lock closure thus obtained can be used as means of locking a flap of a handbag or like article, or otherwise as button, snap closure or hook, for example.

A permanent magnet used may be formed in a cylindrical, rectangular or ring-like shape, or any other shape. The magnet may be enveloped with non-ferromagnetic material such as brass or synthetic resin for its protection and for preserving its appearance.

DETAILED DESCRIPTION OF THE INVENTION

Figure 1:
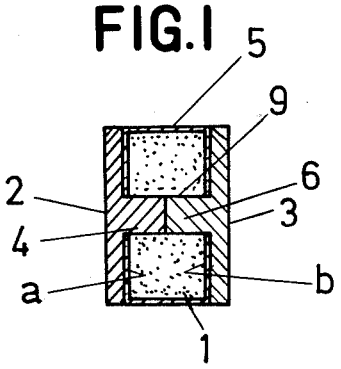
FIG. 1 is a sectional view of a magnet lock closure embodying the invention, showing its two component parts having rod portions of an equal length.
Figure 2:
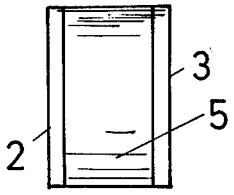
FIG. 2 is a front view of the same.

Referring now to FIGS. 1 and 2, the invention will further be described by way of examples only, as follows.

A permanent magnet 1 of a cylindrical form, for example, is provided which has a different magnetic polarity at opposite ends thereof a and b. The magnet 1 is enveloped with non-ferromagnetic material such as brass 5, for example. A piece 2 of ferromagnetic material such as iron is provided with a rod portion 4, and is rigidly secured to one end a of the magnet. The rod portion 4 is of a length for insertion into half the depth of a hole 9 of the magnet 1. A female device thus constructed comprises a permanent magnet 1, iron piece 2 and brass envelop 5. A piece 3 of iron material is provided as a male device, which preferably has a rod portion 6 centrally thereof, said rod portion 6 having a thickness and length for insertion into the hole 9.

Figure 7:
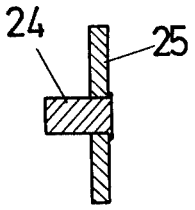
FIG. 7 is a sectional view of an iron piece 3 comprising an iron plate 25 and a pin 24 joined by caulking means.
Figure 8:
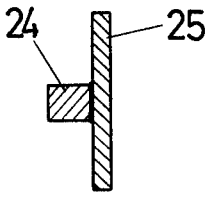
FIG. 8 is a sectional view of an iron piece 3 comprising an iron plate 25 and pin 24 joined by welding means.

In the embodiments described above, the iron pieces 2 and 3 have the rod portions 4 and 6 integrally therewith, respectively. A separate pin 24 may be provided which is passed through and joined with an iron plate 25 by caulking means as in FIG. 7 or joined by welding means as in FIG. 8.

The magnet is enveloped with non-ferromagnetic material such as brass, but this is not limitative; synthetic resin may also be used.

Figure 3:
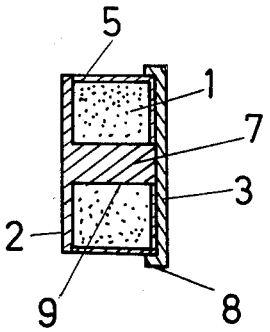
FIG. 3 is a sectional view showing an iron piece 2 having a rod portion of a length for full insertion into a hole.

Referring to FIG. 3, a piece 2 of iron material is provided with a rod portion 7 of a length for insertion into the entire depth of a hole of a magnet 1. However, an iron piece 3 is not provided with such a rod portion as in FIG. 1, but is provided with an annular hook 8 about the marginal portion thereof adapted for holding the magnet 1. The iron piece 3 is attracted by the end of the rod portion 7 upon contact, and is locked by holding the marginal portion of the magnet 1 with the annular hook 8. The iron piece 3 is thus so securely held by both the attraction of the magnet 1 and the annular hook 8 that there is no need of providing such a rod portion 6 for insertion as in FIG. 1.

When a relatively thick magnet is used as shown in FIG. 1, it is desirable that an iron piece 2 be provided with a relatively longer rod portion while an iron piece 3 is provided with a relatively shorter rod portion 6, or that an annular hook is provided for an iron piece 3 instead of such rod portion as in FIG. 3.

Figure 9:
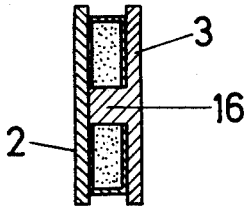
FIG. 9 is a sectional view of an iron piece 3 having a rod portion of a length for full insertion into a hole.

For a magnet of a relatively smaller thickness as indicated in FIG. 9, it is desirable that no such rod portion 4 is provided for an iron piece 2 whereas an iron piece 3 is provided with a rod portion 16 of a length enough to contact the piece 2. These iron pieces 2 and 3 may be constructed in various forms depending on purposes, shapes and/or locations of a lock closure.

Figure 4:
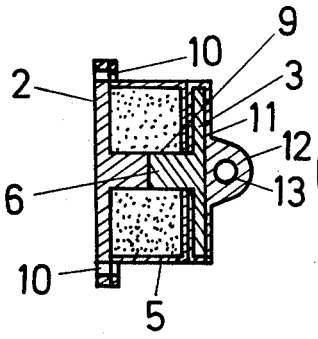
FIG. 4 is a sectional view of a magnet lock closure adapted for use as a button.
Figure 5:
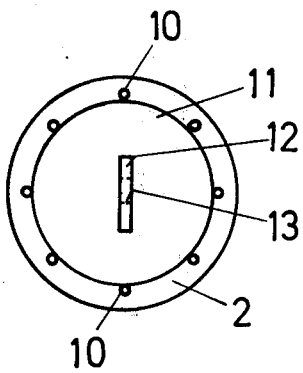
FIG. 5 is a side view of the same.
Figure 6:
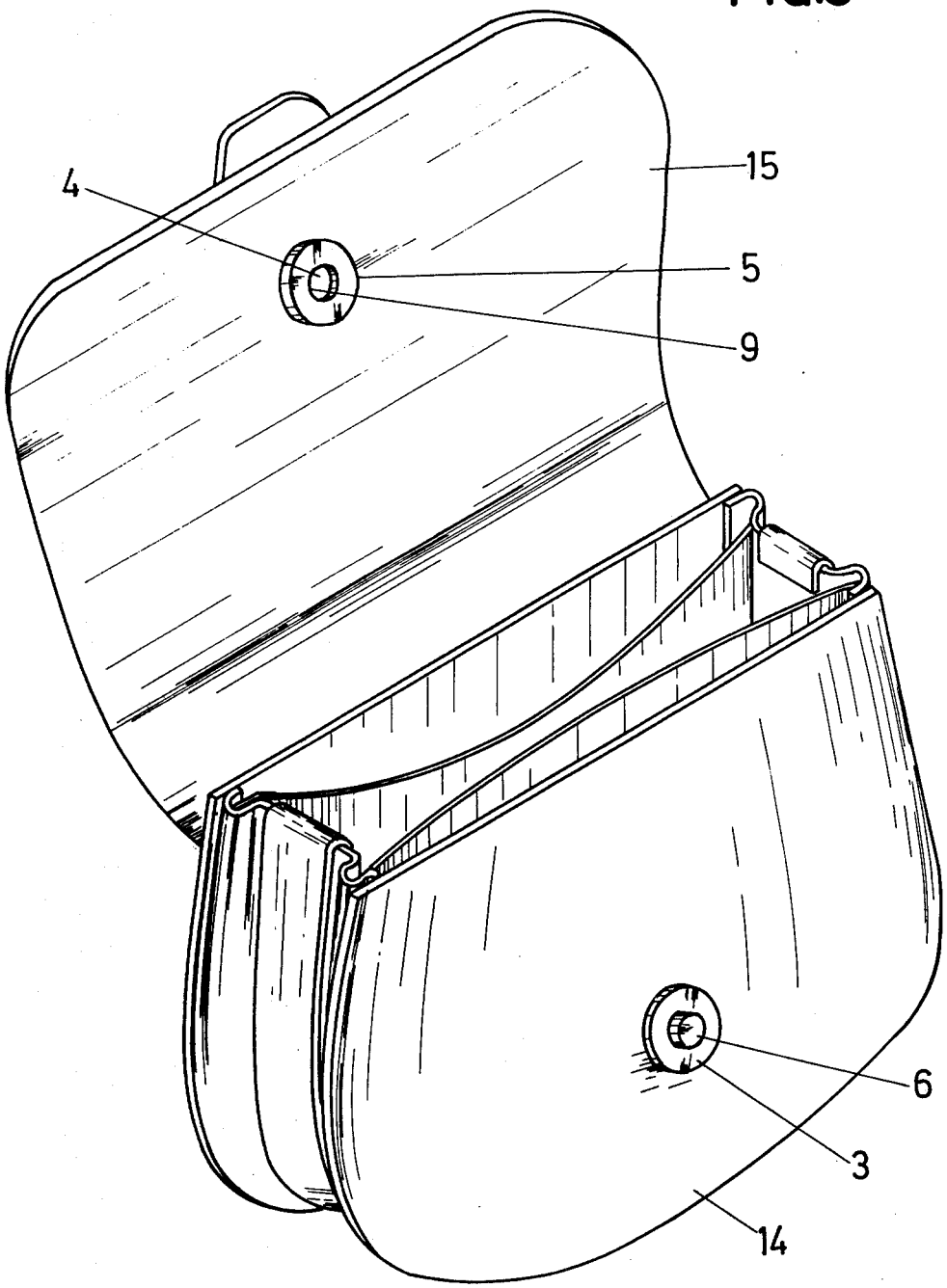
FIG. 6 is a perspective view of the lock closure used for a handbag.

In FIG. 4, a magnetic lock closure embodying the invention is constructed to work as a button, in which an iron piece 2 which is diametrically greater than the magnet is provided with a number of holes 10, 10 in a spaced relation on the marginal portion thereof, and an iron piece 3 is enveloped with synthetic resin film 11, said synthetic resin film 11 having a holder means 12 with a hole 13. The iron piece 3 may be diametrically greater than the magnet, and may be provided with a number of such holes on the marginal portion thereof as provided on the iron piece 2.

Figure 10:
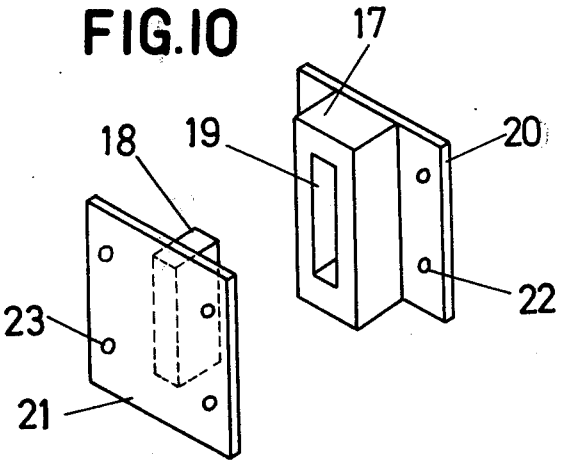
FIG. 10 is a perspective view of a magnetic lock closure constructed in a rectangular form.

The embodiments using a cylindrical or ring-like magnet have heretofore been illustrated. A rectangularform magnet may be used as indicated in FIG. 10, in which the magnet 17 is rigidly secured to an iron piece 20, and is provided with a rectangular slit 19 adapted to receive a rod portion 18 of the same form provided on an iron piece 21. In FIG. 10, reference numerals 22 and 23 are screw holes. This is as advantageous as the earlier embodiments.

Results of the magnetic attraction test were obtained as follows:

The strength of the magnetic attraction of a cylindrical magnet of which the diameter was 18 mm was in the range from 750g to 950g.

Then, in the case where a hole of 7mm in diameter was provided centrally of the magnet and a rod of 6mm in diameter was inserted into the hole, the strength of the magnetic attraction was in the range from 1300g to 1500g.

Accordingly, by centering the magnetic flux into the center, it was observed that the strength of the magnetic attraction was increased by about 60 percent.

What is claimed

1. A magnetic lock closure for use with handbags and similar containers comprising:

magnetic means for supplying magnetic attraction having a first side and a second side of opposite polarities and a hole therethrough between said two sides;

first ferromagnetic material means rigidly secured to said first side of said magnetic means over said hole for centering the force of the magnetic attraction of said magnetic means; and second ferromagnetic material means removably positioned against said second side of said magnetic means for contacting and being attracted to said first ferromagnetic means through said hole, said second ferromagnetic material means comprised of:

a plate adjacent said second side of said magnetic means over said hole, and a rod the shape of said hole rigidly attached to said plate extending through said hole and contacting said first ferro-magnetic material means, whereby said second ferromagnetic material means is magnetically attracted and connected to said first ferromagnetic material means through said hole.

2. A magnetic lock closure as claimed in claim 1, wherein:

said first ferromagnetic means is comprised of a first plate attached to said first side of said magnetic means and a rod the shape of said hole attached to said first plate extending into said hole.

3. A magnetic lock closure as claimed in claim 1, wherein:

said first plate extends beyond said first side and has holes therein, whereby said first plate and the magnetic means attached thereto can be attached to a surface; and said second plate extends beyond said second side and has holes therein whereby said second plate can be attached to a surface.

4. A magnetic lock closure as claimed in claim 1, wherein said first and second ferromagnetic means are comprised of iron.

5. A magnetic lock closure as claimed in claim 1, wherein said magnetic means is comprised of a permanent magnet.

6. A magnetic lock closure as claimed in claim 5, wherein said magnetic means is covered with non-ferromagnetic material.

7. A magnetic lock closure as claimed in claim 5, wherein said magnetic means is a cylindrical shape with a hole therethrough.

8. A magnetic lock closure as claimed in claim 5, wherein said magnetic means is a rectangular shape with a hole therethrough.

* * * * *

REEXAMINATION CERTIFICATE (546th)

United States Patent [19] [11] B1 4,021,891

Morita [45] Certificate Issued Aug. 5, 1986

[54] MAGNETIC LOCK CLOSURE

[75] Inventor: Tamao Morita, Tokyo, Japan

[73] Assignee: Application Art Laboratories Co., Ltd., Tokyo, Japan

Reexamination Request:
No. 90/000,596, Jul. 20, 1984

Reexamination Certificate for:

| | |
|---|---|
| Patent No.: | **4,021,891** |
| Issued: | **May 10, 1977** |
| Appl. No.: | **462,174** |
| Filed: | **Apr. 18, 1974** |

[51] Int. Cl.[4] ..... A44B 21/00; A44B 17/00
[52] U.S. Cl. ..... 24/303; 292/251.5
[58] Field of Search ..... 24/49 M, 303; 296/970; 293/128; 292/251.5; 248/206.5; 211/DIG. 1; 403/405, 407, DIG. 1; 335/302, 285, 286, 295, 303, 306; 339/12 R, 126; 206/818; 150/118; D2/331, 382; 2/422

[56] References Cited

U.S. PATENT DOCUMENTS

| | | | |
|---|---|---|---|
| 1,198,227 | 9/1916 | Hinchey | 211/DIG. 1 |
| 2,340,781 | 2/1944 | Wagner . | |
| 2,397,931 | 4/1946 | Ellis . | |
| 2,453,021 | 11/1948 | Konelsky . | |
| 2,475,226 | 7/1949 | Ellis . | |
| 2,521,885 | 9/1950 | Vasquez . | |
| 2,585,714 | 2/1952 | Wrobel et al. . | |
| 2,615,227 | 10/1952 | Hornik . | |
| 2,623,256 | 12/1952 | Feibelman . | |
| 2,627,423 | 2/1953 | Copeman . | |
| 2,637,887 | 5/1953 | Goodman et al. . | |
| 2,654,929 | 10/1953 | Feibelman . | |
| 2,693,654 | 11/1954 | Clark . | |
| 2,698,917 | 1/1955 | Van Urk et al. . | |
| 2,784,757 | 3/1957 | Bosca et al. . | |
| 2,812,203 | 11/1957 | Scholten . | |
| 2,818,655 | 1/1958 | De Gaston . | |
| 2,826,328 | 3/1958 | Moen et al. . | |
| 2,884,698 | 5/1959 | Würsch . | |
| 2,901,278 | 8/1959 | Robinson . | |
| 2,915,681 | 12/1959 | Troy | 335/295 X |
| 2,954,253 | 9/1960 | Teetor . | |
| 2,954,874 | 10/1960 | Rouse . | |
| 2,970,857 | 2/1961 | Squire . | |
| 2,975,497 | 3/1961 | Budreck . | |
| 3,009,225 | 11/1961 | Budreck . | |
| 3,038,232 | 6/1962 | Wean . | |
| 3,041,697 | 7/1962 | Budreck . | |
| 3,086,268 | 4/1963 | Chaffin . | |
| 3,111,736 | 11/1963 | Budreck . | |
| 3,111,737 | 11/1963 | Heil . | |
| 3,141,214 | 7/1964 | Bey | 24/303 |
| 3,141,216 | 7/1964 | Brett . | |
| 3,171,176 | 3/1965 | Shirley . | |
| 3,223,898 | 12/1965 | Bey . | |
| 3,264,970 | 8/1966 | Hersh et al. | 403/DIG. 1 |
| 3,269,608 | 8/1966 | Weber, III . | |
| 3,277,681 | 10/1966 | Bey . | |
| 3,324,521 | 6/1967 | Humiston . | |
| 3,372,443 | 3/1968 | Daddona . | |
| 3,502,318 | 3/1970 | Merz . | |
| 3,509,734 | 6/1967 | Lederer . | |
| 3,618,174 | 11/1971 | Schainholz et al. . | |
| 3,722,360 | 3/1973 | Blakey et al. . | |
| 3,895,330 | 7/1975 | Yost | 335/285 X |
| 3,919,743 | 11/1975 | Cutter | 24/303 |

FOREIGN PATENT DOCUMENTS

| | | |
|---|---|---|
| 1711236 | 11/1955 | Fed. Rep. of Germany . |
| 1737900 | 1/1959 | Fed. Rep. of Germany . |
| 1068149 | 10/1959 | Fed. Rep. of Germany . |
| 1127509 | 4/1962 | Fed. Rep. of Germany . |
| 2419407 | 11/1975 | Fed. Rep. of Germany . |
| 1586926 | 3/1970 | France . |
| 155313 | 7/1956 | Sweden . |
| 374845 | 3/1964 | Switzerland . |
| 914208 | 12/1962 | United Kingdom . |
| 1009996 | 11/1965 | United Kingdom . |

*Primary Examiner*—William E. Lyddane

[57] ABSTRACT

A magnetic lock closure used for a handbag or the like for closure comprising two separate parts at least one of which is formed as a female device in a permanent magnet of a cylindrical or any other shape having a hole or slit centrally thereof and its opposite ends magnetized in a different polarity, the female device including a piece of ferromagnetic material firmly provided at one end thereof and having a rod portion for insertion into the hole or slit such that the force of its magnetism is centered about the piece of ferromagnetic material which attracts the other part or male device formed of ferromagnetic material.

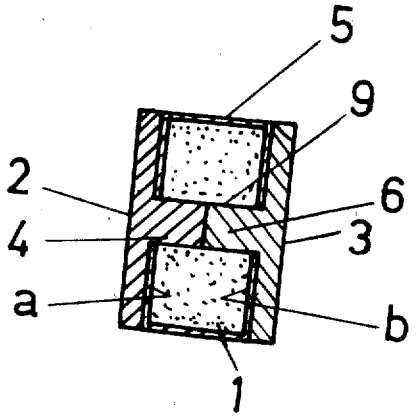

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 5 and 6 are cancelled.

Claims 1–4, 7 and 8 are determined to be patentable as amended.

1. A magnetic lock closure for use with handbags and similar containers comprising:

[magnetic] *a single permanent magnet* means for supplying magnetic attraction having a first side and a second side of opposite polarities and a hole therethrough between said two sides;

*a* first ferromagnetic [material means] *plate-shaped body* rigidly secured to said first side of said [magnetic] *magnet* means over said hole for centering the force of the magnetic attraction of said [magnetic] *magnet* means; [and]

*a* second ferromagnetic [material means] *plate-shaped body* removably positioned against said second side of said [magnetic] *magnet* means for contacting and being attracted to said first ferromagnetic [means] *plate-shaped body* through said hole, said second ferromagnetic [material means comprised of] *plate-shaped body formed as*:

a plate *means* adjacent said second side of said [magnetic] *magnet* means over said hole, and a rod [the shape of said hole] *means extending from said plate means* rigidly [attached to said plate] *secured against substantial movement transverse to the plane of said plate means,* [extending through] *said rod means adapted to extend into* said hole and contacting said first ferromagnetic [material means] *plate-shaped body*, whereby said second ferromagnetic [material means] *plate-shaped body* is magnetically attracted and connected to said first ferromagnetic [material means] *plate-shaped body* through said hole[.]*; and*

*a non-ferromagnetic cover having a central opening adapted to be substantially in register with said hole in said magnet means, said non-ferromagnetic cover superimposed at least over substantially the entire surface of said second side of said magnet means without substantially interfering with the magnetic attraction through said central opening, and to substantially protect the covered portion of said magnet means.*

2. A magnetic lock closure as claimed in claim 1, wherein:

said first ferromagnetic [means] *plate-shaped body* is comprised of a [first] *further* plate *means* attached to said first side of said [magnetic] *magnet* means and a *further* rod *means* the shape of said hole attached to said [first] *further* plate *means and* extending into said hole.

3. A magnetic lock closure as claimed in claim [1] *2*, wherein:

said [first] *further* plate *means* extends beyond said first side and has holes therein, whereby said [first] *further* plate *means* and the [magnetic] *magnet* means attached thereto can be attached to a surface; and said *plate means of said* second [plate] *ferromagnetic plate-shaped body* extends beyond said second side and has holes therein whereby said *plate means of said* second [plate] *ferromagnetic plate-shaped body can be attached to a surface.*

4. A magnetic lock closure as claimed in claim 1, wherein said first and second ferromagnetic [means] *plate-shaped bodies* are comprised of iron.

7. A magnetic lock closure as claimed in claim [5] *1*, wherein said [magnetic] *magnet* means is a cylindrical shape with a hole therethrough.

8. A magnetic lock closure as claimed in claim [5] *1*, wherein said [magnetic] *magnet* means is a rectangular shape with a hole therethrough.

* * * * *

REEXAMINATION CERTIFICATE (754th)

United States Patent [19]

Morita

[11] B2 4,021,891

[45] Certificate Issued Sep. 8, 1987

[54] MAGNETIC LOCK CLOSURE

[75] Inventor: Tamao Morita, Tokyo, Japan

[73] Assignee: Application Art Laboratories Co., Ltd., Tokyo, Japan

Reexamination Request:
No. 90/001,055, Jul. 22, 1986

Reexamination Certificate for:

| | |
|---|---|
| Patent No.: | **4,021,891** |
| Issued: | **May 10, 1977** |
| Appl. No.: | **462,174** |
| Filed: | **Apr. 18, 1974** |

Reexamination Certificate B1 4,021,891, issued Aug. 5, 1986.

[51] Int. Cl.[4] ..... A44B 17/00

[52] U.S. Cl. ..... 24/303; 292/251.5

[56] References Cited

U.S. PATENT DOCUMENTS 1,198,227 9/1916 Hinchey .
2,901,278 8/1959 Robinson .
3,141,216 7/1964 Brett .

FOREIGN PATENT DOCUMENTS 1068149 10/1959 Fed. Rep. of Germany .
1127509 4/1962 Fed. Rep. of Germany .
44-27953 11/1969 Japan .
47-16817 11/1972 Japan .

*Primary Examiner*—James A. Leppink

[57] ABSTRACT

A magnetic lock closure used for a handbag or the like for closure comprising two separate parts at least one of which is formed as a female device in a permanent magnet of a cylindrical or any other shape having a hole or slit centrally thereof and its opposite ends magnetized in a different polarity, the female device including a piece of ferromagnetic material firmly provided at one end thereof and having a rod portion for insertion into the hole or slit such that the force of its magnetism is centered about the piece of ferromagnetic material which attracts the other part or male device formed of ferromagnetic material.

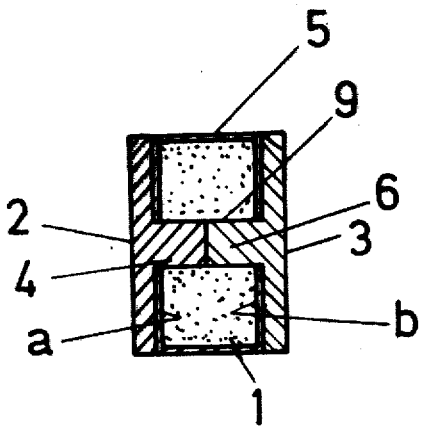

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 5 and 6 were previously cancelled.

Claims 1-3 are determined to be patentable as amended.

Claims 4, 7 and 8, dependent on an amended claim, are determined to be patentable.

1. A magnetic lock closure for use with handbags and similar containers comprising:

*a magnetic attractor member comprised of:* a single permanent magnet means for supplying magnetic attraction having a first side and a second side of opposite polarities and a hole therethrough between said two sides[;]. *and* a first ferromagnetic plate-shaped body rigidly secured to said first side of said magnet means over said hole for centering the force of the magnetic attraction of said magnet means *through said hole, said magnetic attractor member having an outer lateral peripheral surface; and* a second ferromagnetic plate-shaped body removably positioned against said second side of said magnet means for contacting and being attracted to said first ferromagnetic plate-shaped body through said hole, said second ferromagnetic plate-shaped body formed as:

a plate [means] adjacent said second side of said magnet means over said hole, and a rod [means extending from said plate means] *the shape of said hole* rigidly [secured against substantial movement transverse to the plane of said plate means, said rod means adapted to extend into] *attached to said plate extending through* said hole and contacting said first ferromagnetic plate-shaped body, whereby said second ferromagnetic plate-shaped body is magnetically attracted and connected to said first ferromagnetic plate-shaped body *with the magnetic force centered* through said hole; and a non-ferromagnetic *cover member comprised of a* cover having a central opening adapted to be substantially in register with said hole in said magnet means, said [non-ferromagnetic] cover superimposed at least over substantially the entire surface of said second side of said magnet means without substantially interfering with the magnetic attraction through said central opening *and with an outer peripheral edge spaced from said central opening*, and [to] *a continuous flange portion extending around and depending from the entire outer peripheral edge of said cover and extending toward a plane extending laterally outwardly from the junction of said first side of said magnet means and the outer lateral peripheral surface of said magnet means and said flange portion covering substantially the entire outer lateral peripheral surface of said magnetic attractor member extending from said plane toward said second side of said magnet, said cover member* substantially [protect] *protecting* the covered portion of said magnet means.

2. A magnetic lock closure [as claimed in claim 1, wherein: said first ferromagnetic plate-shaped body] *for use with handbags and similar containers comprising:*

*a magnetic attractor member comprised of:*

*a single permanent magnet means for supplying magnetic attraction having a first side and a second side of opposite polarities and a hole therethrough between said two sides, and*

*a first ferromagnetic plate-shaped body rigidly secured to said first side of said magnet means over said hole which* is comprised of a [further] *first* plate [means] attached to said first side of said magnet means and a [further] *first* rod [means] the shape of said hole attached to said [further] *first* plate [means] and extending into said hole *for centering the force of the magnetic attraction of said magnet means through said hole, said magnetic attractor member having an outer lateral peripheral surface; and*

*a second ferromagnetic plate-shaped body removably positioned against said second side of said magnet means for contacting and being attracted to said first ferromagnetic plate-shaped body through said hole, said second ferromagnetic plate-shaped body formed as:*

*a second plate adjacent said second side of said magnet means over said hole, and*

*a second rod the shape of said hole rigidly attached to said second plate extending through the portion of the length of said hole unoccupied by said first rod, and contacting said first rod, whereby said second ferromagnetic plate-shaped body is magnetically attracted and connected to said first ferromagnetic plate-shaped body with the magnetic force centered through said hole; and*

*a non-ferromagnetic cover member comprised of a cover having a central opening adapted to be substantially in register with said hole in said magnet means, said cover superimposed at least over substantially the entire surface of said second side of said magnet means without substantially interfering with the magnetic attraction through said central opening and with an outer peripheral edge spaced from said central opening, and a continuous flange portion extending around and depending from the entire outer peripheral edge of said cover and extending toward a plane extending laterally outwardly from the junction of said first side of said magnet means and the outer lateral peripheral surface of said magnet means and said flange portion covering substantially the entire outer lateral peripheral surface of said magnetic attractor member extending from said plane toward said second side of said magnet, said cover member substantially protecting the covered portion of said magnet means.*

3. A magnetic lock closure as claimed in claim 2, wherein:

said [further] *first* plate [means] *of said first ferromagnetic plate-shaped body* extends beyond said first side and has holes therein, whereby said [further] *first* plate [means] *of said first ferromagnetic plate-shaped body* and the magnet means attached thereto can be attached to a surface; and said *second* plate [means] of said second ferromagnetic plate-shaped body extends beyond said second side and has holes therein whereby said *second* plate [means] of said second ferromagnetic plate-shaped body can be attached to a surface.

* * * * *